US009790963B2

(12) United States Patent
Gomm et al.

(10) Patent No.: US 9,790,963 B2
(45) Date of Patent: Oct. 17, 2017

(54) ELECTRO-HYDROSTATIC ACTUATOR DECELERATION RATE CONTROL SYSTEM

(71) Applicant: Parker-Hannifin Corporation, Cleveland, OH (US)

(72) Inventors: Ralf Gomm, Charlotte, NC (US); Bjorn Eriksson, Linkoping (SE)

(73) Assignee: Parker-Hannifin Corporation, Cleveland, OH (US)

( * ) Notice: Subject to any disclaimer, the term of this patent is extended or adjusted under 35 U.S.C. 154(b) by 361 days.

(21) Appl. No.: 14/441,388

(22) PCT Filed: Nov. 7, 2013

(86) PCT No.: PCT/US2013/068934

§ 371 (c)(1),
(2) Date: May 7, 2015

(87) PCT Pub. No.: WO2014/074708

PCT Pub. Date: May 15, 2014

(65) Prior Publication Data

US 2015/0275927 A1 Oct. 1, 2015

Related U.S. Application Data

(60) Provisional application No. 61/723,439, filed on Nov. 7, 2012.

(51) Int. Cl.
*F15B 11/00* (2006.01)
*F15B 11/04* (2006.01)

(52) U.S. Cl.
CPC ..... *F15B 11/003* (2013.01); *F15B 11/0406* (2013.01); *F15B 2211/20515* (2013.01);
(Continued)

(58) Field of Classification Search
CPC ..... F15B 11/003; F15B 11/048; F15B 2211/30515; F15B 2211/20561
(Continued)

(56) References Cited

U.S. PATENT DOCUMENTS 5,617,723 A 4/1997 Hosseini et al.
5,778,671 A * 7/1998 Bloomquist ..... F15B 21/087 417/371

(Continued)

FOREIGN PATENT DOCUMENTS

DE 10030137 2/2001
DE 10158325 6/2003

(Continued)

OTHER PUBLICATIONS

International Search Report and Written Opinion for corresponding Patent Application No. PCT/US2013/068934 dated Feb. 12, 2014.

(Continued)

*Primary Examiner* — Thomas E Lazo
(74) *Attorney, Agent, or Firm* — Renner, Otto, Boisselle & Sklar, LLP

(57) ABSTRACT

Presented is a system and method to control hydraulic fluid flow, more specifically throttle hydraulic fluid flow, to achieve actuator deceleration rates greater than the maximum deceleration rate of an electrically driven pump. Electric machines and electric machine inverters generally have a maximum torque and current limit beyond which they cannot be operated at. To decelerate a large inertia load for example, high electric machine torque and inverter current are required to provide the braking torque, opposing the fluid flow and pressure generated by the load and hydraulic system.

20 Claims, 4 Drawing Sheets

(52) U.S. Cl.
CPC ..... *F15B 2211/20561* (2013.01); *F15B 2211/251* (2013.01); *F15B 2211/27* (2013.01); *F15B 2211/30515* (2013.01); *F15B 2211/6346* (2013.01); *F15B 2211/665* (2013.01); *F15B 2211/6651* (2013.01); *F15B 2211/853* (2013.01)

(58) Field of Classification Search
USPC ..... 60/473, 476
See application file for complete search history.

(56) References Cited

U.S. PATENT DOCUMENTS 5,937,646 A * 8/1999 Zakula ..... F15B 11/0426 60/430
6,912,849 B2 * 7/2005 Inoue ..... E02F 9/2217 417/225
6,962,050 B2 * 11/2005 Hiraki ..... E02F 9/2217 60/414
7,243,494 B2 * 7/2007 Evans ..... B66F 9/22 60/469
7,578,127 B2 * 8/2009 Griswold ..... F15B 7/006 60/422
7,973,499 B2 7/2011 Yoshioka
8,720,197 B2 * 5/2014 Persson ..... E02F 9/2217 60/456
2007/0166168 A1 * 7/2007 Vigholm ..... E02F 9/2207 417/20
2009/0319133 A1 12/2009 Ekvall et al.
2011/0030364 A1 2/2011 Persson et al.
2011/0209471 A1 * 9/2011 Vanderlaan ..... F15B 7/006 60/446
2012/0216519 A1 * 8/2012 Peterson ..... F15B 21/087 60/327
2012/0260642 A1 * 10/2012 Opdenbosch ..... F15B 7/006 60/327

FOREIGN PATENT DOCUMENTS

DE 10203160 8/2003
EP 2708661 3/2014

OTHER PUBLICATIONS

Written Opinion for corresponding Patent Application No. PCT/US2013/068934 dated Jan. 16, 2015.
International Preliminary Report on Patentability for corresponding Patent Application No. PCT/US2013/068934 dated Feb. 23, 2015.

* cited by examiner

ELECTRO-HYDROSTATIC ACTUATOR DECELERATION RATE CONTROL SYSTEM

RELATED APPLICATIONS

This application is a national phase of International Application No. PCT/US2013/068934 filed on Nov. 7, 2013 and published in the English language, which claims the benefit of U.S. Provisional Application No. 61/723,439 filed Nov. 7, 2012, which is hereby incorporated herein by reference.

FIELD OF INVENTION

The present invention relates generally to hydraulic actuation systems for extending and retracting at least one actuator in a work machine, and more particularly to electro-hydrostatic actuation systems requiring actuator retraction speeds that exceed the electric motor maximum speed capability.

BACKGROUND

It is common for a work machine such as but not limited to hydraulic excavators, wheel loaders, loading shovels, backhoe shovels, mining equipment, industrial machinery and the like, to have one or more actuated components such as lifting and/or tilting arms, booms, buckets, steering and turning functions, traveling means, etc. Commonly, in such machines, a prime mover drives a hydraulic pump for providing fluid to the actuators. Open-center or closed-center valves control the flow of fluid to the actuators.

Some modern machines have replaced the traditional hydraulic system described above with an electro-hydrostatic actuator system (EHA). An electro-hydrostatic actuator includes a reversible, variable speed electric motor that is connected to a hydraulic pump, generally fixed displacement, for providing fluid to an actuator for controlling motion of the actuator. The speed and direction of the electric motor controls the flow of fluid to the actuator. Power for the electric motor is received from a power unit, for example a generator, a power storage unit, such as a battery, or both. A system that includes an electro-hydrostatic actuator is referred to herein as an electro-hydrostatic actuator system. At, for example, deceleration and/or lowering motion of a load, the power unit receives power from the said electric motor that is then operated as a generator.

SUMMARY OF INVENTION

There is a problem that electric machines and electric machine inverters generally have a maximum torque and current limit beyond which they cannot be operated at. To decelerate a large inertia load for example, high electric machine torque and inverter current are required to provide the braking torque, opposing the fluid flow and pressure generated by the load and hydraulic system. Therefore, presented is a system and method to control hydraulic fluid flow, more specifically throttle hydraulic fluid flow, to achieve actuator deceleration rates greater than the maximum deceleration rate of an electrically driven pump.

According to one aspect of the invention, a hydraulic system comprising a controller connected to an operator interface; a first load holding command operatively connected to the controller; and a pump operable in a first direction for supplying pressurized fluid through the first load holding valve; wherein the controller is configured to receive a requested actuator deceleration, to compare the requested actuator deceleration with a predetermined threshold, and to control the first load holding valve to close if it is determined that the requested deceleration is above the predetermined threshold.

Optionally, the pump is a bi-directional pump operable in a first direction for supplying pressurized fluid through a first load holding valve to a hydraulic actuator for operating the actuator in one direction, and operable in a second direction opposite the first direction for supplying pressurized fluid through a second holding valve to the hydraulic actuator for operating the actuator in a direction opposite the first direction, Optionally, the hydraulic system includes a hydraulic actuator to and from which hydraulic fluid is supplied and returned in opposite directions to operate the actuator in opposite directions.

Optionally, the hydraulic system includes a boost system for accepting fluid from or supplying fluid to a hydraulic circuit of the hydraulic system.

Optionally, the boost system includes a boost pump for supplying fluid to a fluid make-up/return line that selectively is in fluid communication with the hydraulic actuator, and a boost electric machine for driving the boost pump, the electric machine connected to a boost electric power source through a boost inverter.

Optionally, the pump is a bi-directional pump operable in a second direction opposite the first direction for supplying pressurized fluid through a second load holding valve.

Optionally, the hydraulic system includes an electric machine connected to an electrical source through an inverter to drive the pump.

Optionally, the threshold is set to a level at which the electric machine cannot provide a required braking torque to achieve a requested actuator deceleration.

Optionally, the threshold is set to a level at which the inverter cannot provide a required braking current to achieve the requested actuator deceleration.

Optionally, the requested actuator deceleration rate is greater than the maximum deceleration rate of the electrically driven pump.

According to another aspect of the invention, a method of controlling deceleration of an actuator in a hydraulic system includes the steps of receiving a requested deceleration rate of an actuator; comparing the requested deceleration rate with a predetermined threshold; and generating a control signal to close a first load holding valve if the requested deceleration rate is greater that the predetermined threshold.

Optionally, the predetermined threshold is based on the maximum deceleration rate of an electrically driven pump of the hydraulic system.

Optionally, the method includes operating a bi-directional pump in one direction for supplying pressurized fluid through the first load holding valve to the hydraulic actuator for operating the actuator in a first direction, and operating the pump in a second direction opposite the first direction for supplying pressurized fluid through a second holding valve to the hydraulic actuator for operating the actuator in a direction opposite the first direction.

Optionally, the method includes supplying and returning hydraulic fluid to and from the hydraulic actuator in opposite directions to operate the actuator in opposite directions.

Optionally the method includes accepting fluid from or supplying fluid to the hydraulic system via a boost system.

Optionally, the method includes supplying fluid to a fluid make-up/return line that selectively is in fluid communication with the hydraulic actuator via a boost pump, and driving the boost pump with an electric machine, the electric machine connected to a boost electric power source through a boost inverter.

Optionally, the pump is a bi-directional pump operable in a second direction opposite the first direction for supplying pressurized fluid through a second load holding valve.

Optionally, the method includes driving the pump via an electric machine connected to an electrical source through an inverter.

Optionally, the threshold is set to a level at which the electric machine cannot provide a required braking torque to achieve a requested actuator deceleration.

Optionally, the threshold is set to a level at which the inverter cannot provide a required braking current to achieve the requested actuator deceleration.

The foregoing and other features of the invention are hereinafter described in greater detail with reference to the accompanying drawings.

DETAILED DESCRIPTION

Exemplary embodiments of the invention relate generally to hydraulic actuation systems for extending and retracting at least one asymmetric hydraulic cylinder in a work machine, such as but not limited to hydraulic excavators, wheel loaders, loading shovels, backhoe shovels, mining equipment, industrial machinery and the like, having one or more actuated components such as lifting and/or tilting arms, booms, buckets, steering and turning functions, traveling means, etc.

Presented is a system and method to control hydraulic fluid flow, more specifically throttle hydraulic fluid flow, to achieve actuator deceleration rates greater than the maximum deceleration rate of an electrically driven pump. Electric machines and electric machine inverters generally have a maximum torque and current limit beyond which they cannot be operated at. To decelerate a large inertia load for example, high electric machine torque and inverter current are required to provide the braking torque, opposing the fluid flow and pressure generated by the load and hydraulic system.

The method may be used to achieve higher system response and implement features such as "bucket shake" to shake off excess soil from the bucket, for example. Further, the method may be used to reduce electrical braking current and energy recuperation when external loads are decelerated using an electro-hydrostatic actuator system by shifting the balance between electrical recuperation and hydraulic dissipation. This can be used to prevent large electrical current within the electric machine, inverter and electrical storage unit, for example.

Figure 1:
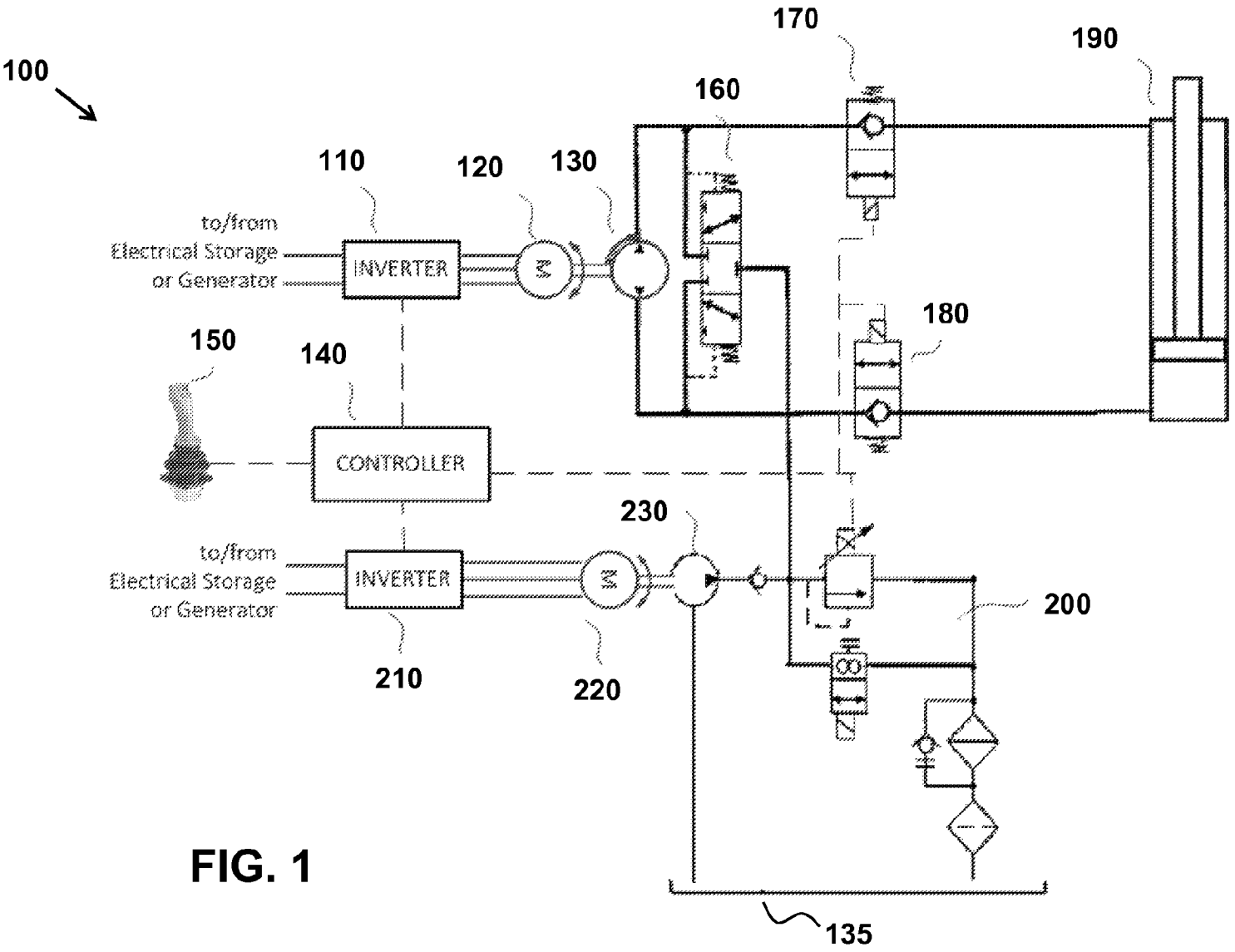
FIG. 1 illustrates an exemplary schematic embodiment of a system constructed in accordance with the present invention.

Referring in detail to FIG. 1, an exemplary embodiment of an electro-hydrostatic actuator system 100 is shown. The system includes at least one actuator 190 to be mechanically connected to a work machine and hydraulically connected to the system 100.

An inverter 110 may be connected to an electrical energy source or energy unit such as an electrical storage (e.g., one or more batteries) or a generator and controls an electric machine 120 (e.g., an electric motor) in bi-directional speed or torque control mode. The electric machine 120 may be mechanically coupled to and drive a hydraulic pump 130, which may be any appropriate type, but is generally a fixed displacement, variable speed pump. The inverter may also store energy generated by the electrical machine in the storage when the pump is back-driven by hydraulic fluid, for example, during a down motion of the actuator when under an external load.

The operator of the system may command a desired actuator speed or force through an input device such as a joystick 150 connected to a controller 140. In other embodiments, a separate command controller may generate the command signal that is passed to the controller 140, for example if the work machine is being remotely or autonomously controlled.

The controller 140 issues commands to the inverter 110 which in conjunction with the motor 120 and pump 130 allows generation of bi-directional flow and pressure via the hydraulic pump 130. The flow is then directed through load holding valves 170, 180 to the actuator 190 yielding the desired actuator motion.

FIG. 1 shows the load holding valves 170, 180 as being ON/OFF type valves, however either or both of these valves could also be flow-control valves, orifice valves or any other proportionally adjustable valve. Exemplary valves are poppet valves so as to prevent leakage through the valves when the valves are closed.

Because most mobile machinery uses un-balanced actuators with a large and small volume chamber, a flow management system 200, for example as presented in U.S. Patent Application Publication No. 2011/0030364 A1 (incorporated herein by reference), controlled by a second inverter 210 and second electric machine 220 and second hydraulic pump 230, provides whatever input flow required by the actuator pump 130 via the shuttle valve 160.

During an actuator extend motion to lift a load, the actuator pump 130 provides flow into the large volume of the actuator 190 (the piston side) and the flow management system 200 is connected to the actuator pump inlet via the shuttle valve 160, ensuring that the flow difference of large volume minus small volume (the rod side) is provided to the actuator pump 130.

During an actuator retraction motion to lower a load, the actuator pump 130 consumes flow from the large volume of the actuator 190 and the flow management system 200 is connected to the actuator pump outlet via the shuttle valve 160, diverting excess flow of large volume minus small volume back to the flow management system 200 and ultimately to the hydraulic reservoir 135.

Although the actuator depicted in a cylinder, it is contemplated that other actuators are possible. Further, the orientation of the cylinder may be reversed from that which is shown.

Figure 2:
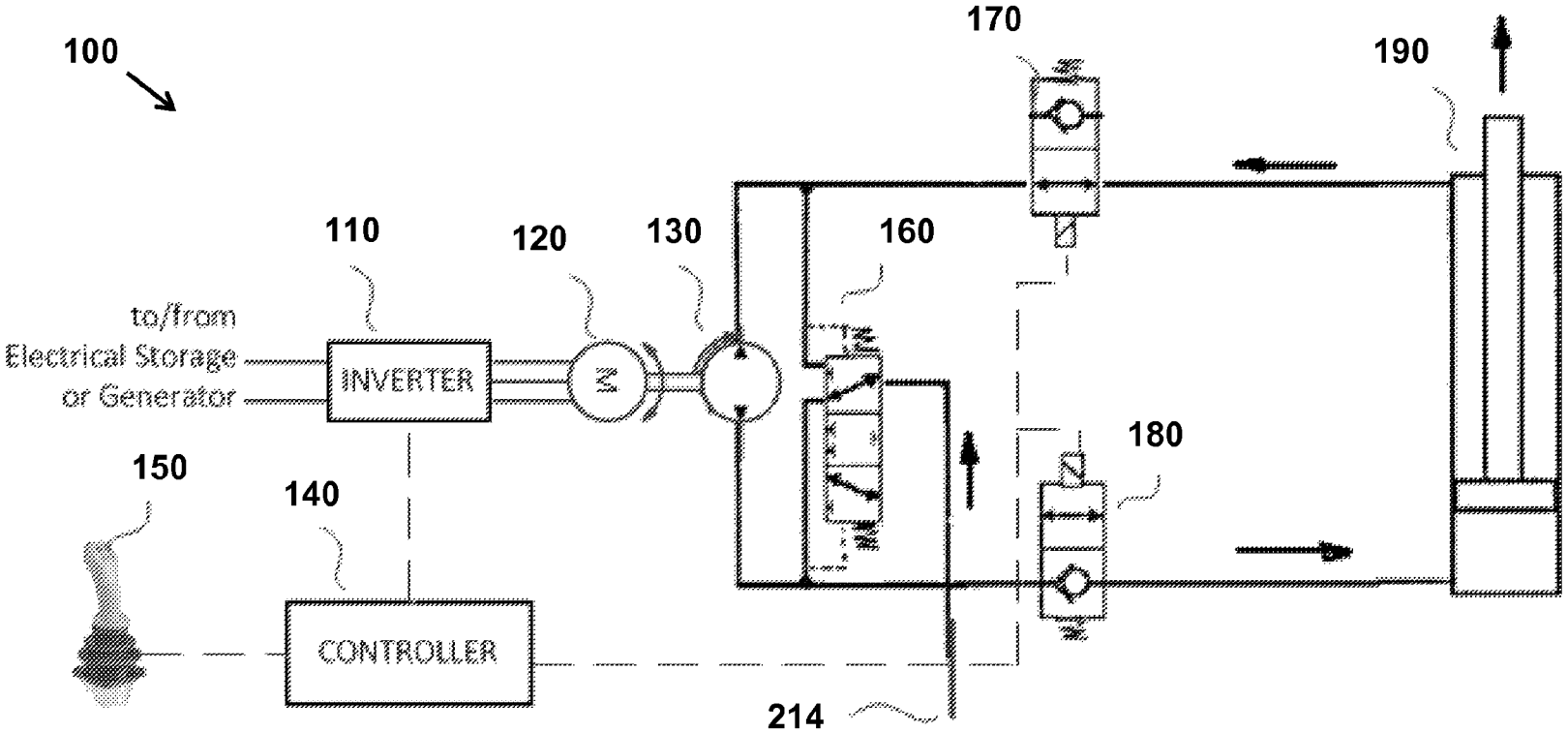
FIG. 2 illustrates an exemplary, simplified schematic embodiment of a system showing an actuator extension motion, direction of fluid flow indicated by arrows and load holding valve states to enable this motion.

Referring now in detail to FIG. 2, an exemplary embodiment of an electro-hydrostatic actuator system 100 is shown.

The system is the same as that shown in FIG. 1, except that the flow management system 200 is hidden to focus on operation of the remaining system. Hydraulic connection 214 indicates the to/from connection to the flow management system 200 shown in FIG. 1.

The arrows indicate hydraulic fluid flow direction in the system. In order to enable an actuator extension motion, load holding valve 170 needs to be commanded open as indicated to allow fluid flow from the small volume of the actuator back to the electrically driven pump 130. Load holding valve 180 does not have to be commanded open in this case, since the type of valve used in this example includes a check valve that will pass flow freely from pump 130 into the large volume of the actuator.

If the operator commands a stop of motion by using the joystick 150, thereby passing a requested deceleration rate to the controller 140, the controller can make a determination regarding the rate of deceleration desired by the operator and electric machine torque required to support that deceleration. If it is determined that the electric machine cannot provide the braking torque requested, or that the inverter cannot provide the braking current provided, the controller will command the load holding valve 170 to close in such a way that the operator desired actuator deceleration is achieved.

Figure 3:
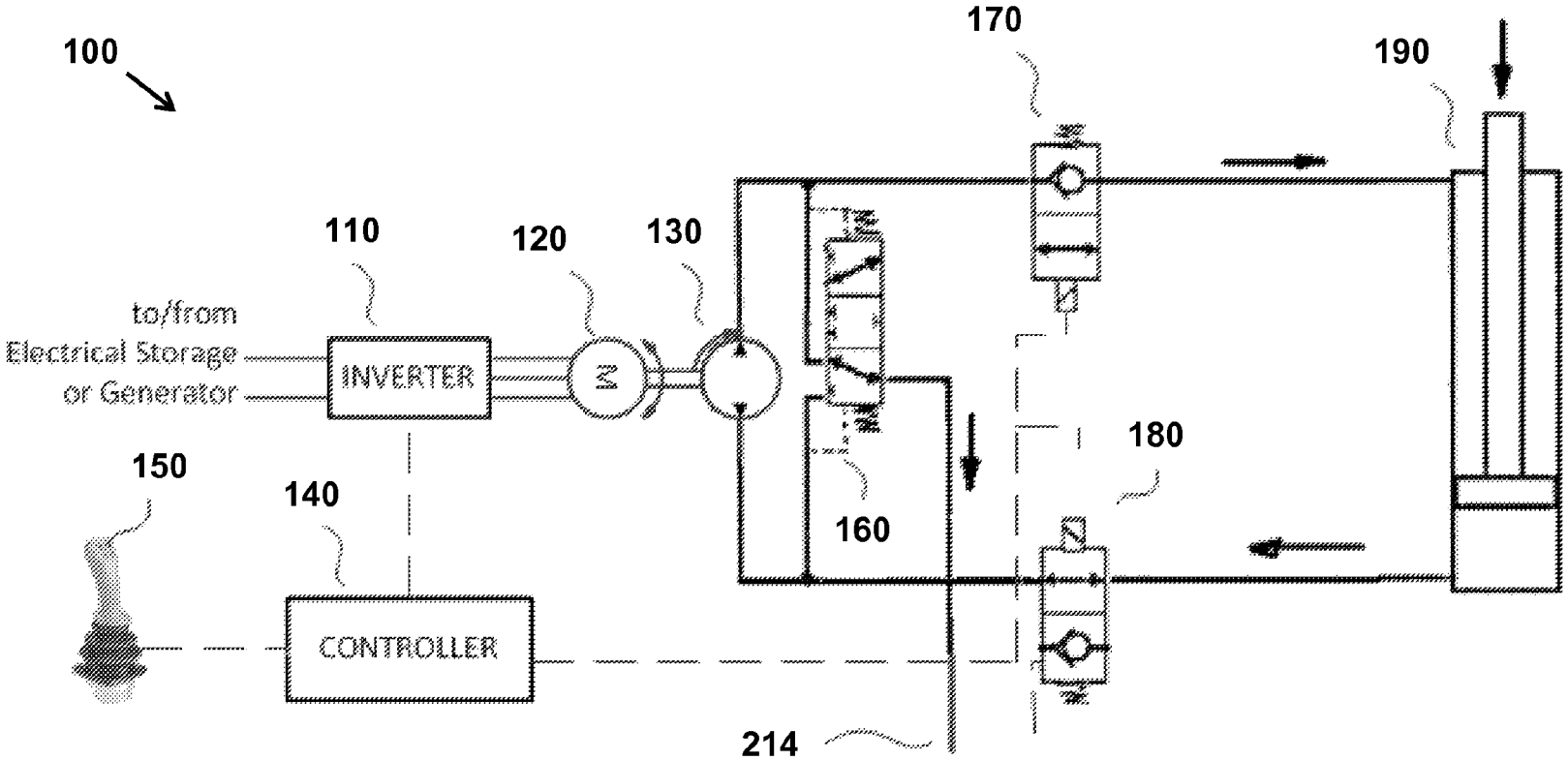
FIG. 3 illustrates an exemplary, simplified embodiment of a system showing an actuator retraction motion, direction of fluid flow indicated by arrows and load holding valve states to enable this motion.

Referring now in detail to FIG. 3, an exemplary embodiment of an electro-hydrostatic actuator system is shown. The system is the same as that shown in FIG. 1, except that the flow management system 200 is hidden to focus on operation of the remaining system. Hydraulic connection 214 indicates the to/from connection to the flow management system shown as item 200 in FIG. 1. The arrows indicate hydraulic fluid flow direction in the system.

In order to enable an actuator retraction motion, load holding valve 180 is commanded open as indicated to allow fluid flow from the large volume of the actuator back to the electrically driven pump 130. Load holding valve 170 does not have to be commanded open in this case, since the type of valve used in this example includes a check valve that will pass flow freely from pump 130 into the large volume of the actuator. However, it is contemplated that another valve type without this check feature could be utilized, in which case, an open signal would be generated to open this valve.

If the operator commands a stop of motion by using the joystick 150, the controller 140 can make a determination regarding the rate of deceleration desired by the operator and electric machine torque required to support that deceleration. If it is determined that the electric machine cannot provide the braking torque requested, or that the inverter cannot provide the braking current provided, the controller will command the load holding valve 180 close in such a way that the operator desired actuator deceleration is achieved.

In general, the desired rate of deceleration can be achieved by only commanding electric machine deceleration if sufficient torque and current is available, by only commanding the load holding valves, or a combination of both. To determine the required braking torque and inverter current, a variety of sensors can be used to identify the load or force acting on the actuator as well as actuator speed. For example, it is possible to read electric machine torque and speed directly from the inverter from which the load and actuator speed can be calculated, and required braking torque and current can be identified. In another non-limiting example, it is possible to use pressure and flow sensors to yield the same results. On having skill in the art will be able to determine which of these or other suitable sensory options to use upon reading and understanding this disclosure.

Figure 4:
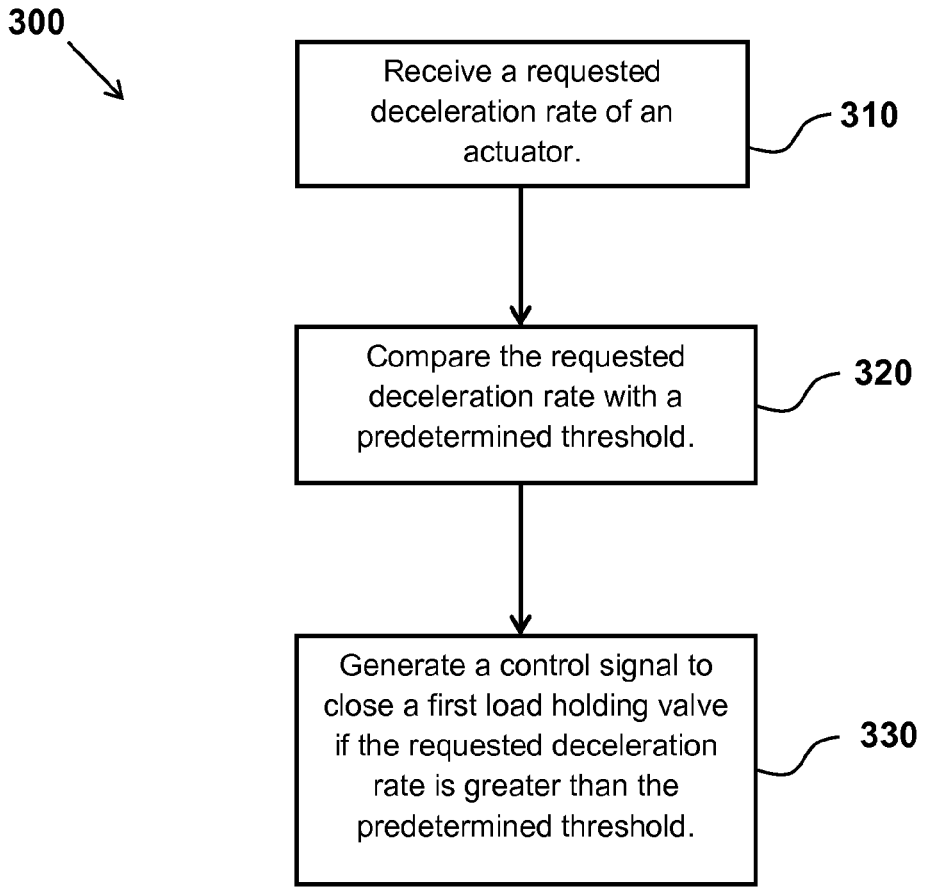
FIG. 4 illustrates a signal control flow diagram depicting an exemplary method for controlling exemplary hydraulic systems.

Referring now to FIG. 4, presented is a method 300 to control hydraulic fluid flow, more specifically throttle hydraulic fluid flow, to achieve actuator deceleration rates greater than the maximum deceleration rate of an electrically driven pump. The method solves a problem that electric machines and electric machine inverters generally have a maximum torque and current limit beyond which they cannot be operated at. To decelerate a large inertia load for example, high electric machine torque and inverter current are required to provide the braking torque, opposing the fluid flow and pressure generated by the load and hydraulic system. While an alternate approach could be to increase the electric machine torque capability and the inverter current capability, it is typically desirable to reduce electric machine and inverter size in order to reduce component size, weight, losses and cost.

The method addresses two main issues. First, the method achieves actuator deceleration rates greater than maximum inverter, electric machine and hydraulic pump deceleration rates. This is used to achieve higher system response and implement features such as "bucket shake" to shake off excess soil from the bucket, for example. Second, the method reduces electrical braking current and energy recuperation when external loads are decelerated using an electro-hydrostatic actuator system by shifting the balance between electrical recuperation and hydraulic dissipation. This can be used to prevent large electrical current within the electric machine, inverter and electrical storage unit, for example.

At block 310, a requested deceleration rate of an actuator is received by a controller, for example, by a joystick manipulated by a user of the work machine. In particular, a user may indicate that a manipulator arm should stop suddenly by quickly moving a joystick from a fully engaged position to a middle, or "at rest" position. Alternatively, perhaps a dedicated button is depressed which indicates a pre-set movement such as a "shake."

At block 320 the requested deceleration rate is compared with a predetermined threshold. This threshold may be based on the maximum deceleration rate of an electrically driven pump of the hydraulic system. In particular, the threshold may be set to a level at which the electric machine cannot provide a required braking torque to achieve a requested actuator deceleration. Alternatively or additionally, the threshold may be set to a level at which the inverter cannot provide a required braking current to achieve the requested actuator deceleration.

At block 330, a control signal to close a first load holding valve if the requested deceleration rate is greater than the predetermined threshold is generated. In cases in which the load holding valve is an ON/OFF valve, the generated command may be a simple command to close the valve. In cases where the load holding valve is a proportional valve, the generated command may be a "full close" command, or it may be a proportional command to partially close the valve, or it may be a variable signal that closes the valve at a determined close rate. Further, ON/OFF valves may be selected and tuned so as to mimic a proportional valve by closing relatively slowly.

In cases where a proportional valve is used, the controller will determine the speed and/or degree of closure of the valve based on the requested deceleration and upon the deceleration caused by the pump/motor. Typically, the motor and the valves are, therefore, controlled in parallel, however, the valves may be used on their own in extreme stop ratios or in cases of failure in the pump and/or motor.

Further, as mentioned above in relation to system 100, both load holding valves 107 and 108 may be controlled at the same time, for example to minimize rebound in a case in which the second valve does not include a check feature. Other benefits in such a case may include protecting the pump and/or motor from blowing out. In contrast, the second load holding valve, regardless of whether it includes a check feature, could be opened on a quick stop in order to achieve active damping of the system.

While for purposes of simplicity of explanation, the illustrated method is shown and described above as a series of blocks, it is to be appreciated that the method is not limited by the order of the blocks, as some blocks can occur in different orders or concurrently with other blocks from that shown or described. Moreover, less than all the illustrated blocks may be required to implement an example methodology. Furthermore, additional or alternative methodologies can employ additional, not illustrated blocks.

In the flow diagram, blocks denote "processing blocks" that may be implemented with logic. The processing blocks may represent a method step or an apparatus element for performing the method step. A flow diagram does not depict syntax for any particular programming language, methodology, or style (e.g., procedural, object-oriented). Rather, a flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown or that blocks may be combined or separated into multiple components. It will be appreciated that the processes may be implemented using various programming approaches like machine language, procedural, object oriented or artificial intelligence techniques.

In one example, methodologies are implemented as processor executable instructions or operations provided on a computer-readable medium. Thus, in one example, a computer-readable medium may store processor executable instructions operable to perform a method.

While FIG. 4 illustrates various actions occurring in serial, it is to be appreciated that various actions illustrated in FIG. 4 could occur substantially in parallel.

"Logic," as used herein, includes but is not limited to hardware, firmware, software or combinations of each to perform a function(s) or an action(s), or to cause a function or action from another logic, method, or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

"Software," as used herein, includes but is not limited to, one or more computer or processor instructions that can be read, interpreted, compiled, or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software may also be implemented in a variety of executable or loadable forms including, but not limited to, a stand-alone program, a function call (local or remote), a servelet, an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or executable instructions can be located in one logic or distributed between two or more communicating, co-operating, or parallel processing logics and thus can be loaded or executed in serial, parallel, massively parallel and other manners.

Suitable software for implementing the various components of the example systems and methods described herein may be produced using programming languages and tools like Java, Java Script, Java.NET, ASP.NET, VB.NET, Cocoa, Pascal, C#, C++, C, CGI, Perl, SQL, APIs, SDKs, assembly, firmware, microcode, or other languages and tools. Software, whether an entire system or a component of a system, may be embodied as an article of manufacture and maintained or provided as part of a computer-readable medium.

Algorithmic descriptions and representations used herein are the means used by those skilled in the art to convey the substance of their work to others. An algorithm or method is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic system comprising:

a controller connected to an operator interface;

a first load holding valve operatively connected to the controller;

a pump operable in a first direction for supplying pressurized fluid through the first load holding valve, the pump operatively connected to the controller;

wherein the controller is configured to receive a requested actuator deceleration, to compare the requested actuator deceleration with a predetermined threshold, and to control the first load holding valve to close, causing actuator deceleration equal to the requested actuator deceleration, if it is determined that the requested deceleration is above the predetermined threshold, and to control the pump to cause actuator deceleration equal to the requested actuator deceleration if it is determined that the requested deceleration is not above the predetermined threshold.

2. The hydraulic system of claim 1, wherein the pump is a bi-directional pump operable in a first direction for supplying pressurized fluid through a first load holding valve to a hydraulic actuator for operating the actuator in one direction, and operable in a second direction opposite the first direction for supplying pressurized fluid through a second holding valve to the hydraulic actuator for operating the actuator in a direction opposite the first direction.

3. The hydraulic system of claim 1, further comprising:

a hydraulic actuator to and from which hydraulic fluid is supplied and returned in opposite directions to operate the actuator in opposite directions.

4. The hydraulic system of claim 1, further comprising:

a boost system for accepting fluid from or supplying fluid to a hydraulic circuit of the hydraulic system.

5. The hydraulic system of claim 4 wherein the boost system includes:

a boost pump for supplying fluid to a fluid make-up/return line that selectively is in fluid communication with the hydraulic actuator, and a boost electric machine for driving the boost pump, the electric machine connected to a boost electric power source through a boost inverter.

6. The hydraulic system of claim 1, wherein the pump is a bi-directional pump operable in a second direction opposite the first direction for supplying pressurized fluid through a second load holding valve.

7. The hydraulic system of claim 1, further comprising:

an electric machine connected to an electrical source through an inverter to drive the pump.

8. The hydraulic system of claim 1, wherein the threshold is set to a level at which the electric machine cannot provide a required braking torque to achieve a requested actuator deceleration.

9. The hydraulic system of claim 1, wherein the threshold is set to a level at which the inverter cannot provide a required braking current to achieve the requested actuator deceleration.

10. The hydraulic system of claim 1, wherein the requested actuator deceleration rate is greater than the maximum deceleration rate of the electrically driven pump.

11. A method of controlling deceleration of an actuator in a hydraulic system, the method comprising the steps of:

receiving a requested deceleration rate of an actuator;

comparing the requested deceleration rate with a predetermined threshold;

generating a control signal to close a first load holding valve, causing an actuator deceleration rate equal to the requested deceleration rate if the requested deceleration rate is greater than the predetermined threshold, and generating a control signal to operate an electrically driven pump, causing an actuator deceleration rate equal to the requested rate if the requested deceleration rate is not greater than the predetermined threshold.

12. The method of claim 11, wherein the predetermined threshold is based on the maximum deceleration rate of the electrically driven pump of the hydraulic system.

13. The hydraulic system of claim 11, wherein the pump is a bi-directional pump operable in a second direction opposite the first direction for supplying pressurized fluid through a second load holding valve.

14. The hydraulic system of claim 11, further comprising:

driving the pump via an electric machine connected to an electrical source through an inverter.

15. The hydraulic system of claim 11, wherein the threshold is set to a level at which the electric machine cannot provide a required braking torque to achieve a requested actuator deceleration.

16. The hydraulic system of claim 11, wherein the threshold is set to a level at which the inverter cannot provide a required braking current to achieve the requested actuator deceleration.

17. The hydraulic system of claim 11, wherein the controller is configured to determine the electric machine torque required to support the requested deceleration.

18. The hydraulic system of claim 11, wherein the controller is configured to determine whether or not electric machine can provide the braking torque required by the requested deceleration.

19. The hydraulic system of claim 11, wherein the controller is configured to determine whether the inverter can provide the braking current required by the requested deceleration.

20. The hydraulic system of claim 17, wherein the controller is configured to command the load holding valve to close in such a way that the requested deceleration is achieved in response to a determination that the electric machine cannot provide the braking torque required by the requested deceleration or in response to a determination that the inverter cannot provide the braking current required by the requested deceleration.

* * * * *